United States Patent [19]

Shoup

[11] 3,984,026

[45] Oct. 5, 1976

[54] COMBINED CAN OPENING AND SEALING DEVICE

[76] Inventor: Russel W. Shoup, 372 Temple Ave., Long Beach, Calif. 90814

[22] Filed: Mar. 26, 1976

[21] Appl. No.: 670,648

[52] U.S. Cl. ..... 220/278

[51] Int. Cl.[2] ..... B65D 41/02

[58] Field of Search ..... 220/277, 278; 30/3; 222/80–83, 85; 221/30

[56] References Cited

UNITED STATES PATENTS

| | | | |
|---|---|---|---|
| 2,297,592 | 9/1942 | Walter | 220/278 X |
| 3,071,286 | 1/1963 | Valvano | 220/278 |

*Primary Examiner*—George T. Hall

*Attorney, Agent, or Firm*—William C. Babcock

[57] ABSTRACT

A light weight portable device that removably engages a container having a cylindrical side wall to not only form two diametrically spaced openings in one end of the container, but to seal the two openings after the same are formed. When it is desired to dispense liquid from the container, the device is removed therefrom, with the container thereafter being tilted for liquid to flow through one of the openings and air flowing inwardly into the interior of the container through the other of the openings. After liquid is dispensed from the container, the latter is placed in an upright position, and the invention disposed in the sealing position thereon.

4 Claims, 5 Drawing Figures

COMBINED CAN OPENING AND SEALING DEVICE

BACKGROUND OF THE INVENTION

1. Field of the Invention

Combined Can Opening and Sealing Device.

2. Description of the Prior Art

Numerous liquid products are currently sold in containers having cylindrical side walls and circular ends. Sucn containers are normally opened by forming two spaced openings in one end thereof, with liquid when the container is tilted in an appropriate manner flowing by gravity through one of the openings, and the other of the openings allowing air to flow into the interior of the container. Frequently, but a portion of the contents of a container of the above-described type will be used. When but a portion of the contents of a container is used, a troublesome problem arises as to how the container can be sealed to prevent contamination of the unused portion thereof from foreign material in the ambient atmosphere.

Various devices have been proposed and used to attempt to provide a seal for an opened container, such seals including but not being limited to plastic caps and the like that may be removably mounted on an end portion of the container after openings have been formed therein. However, such sealing devices unduly increase the cost of the container, without providing a truly satisfactory seal. Furthermore, the prior art sealing devices provide no easily usable means to form two spaced openings in an end of a container.

A major object of the present invention is to furnish a device that will overcome the operational disadvantages of prior art seals, and accomplish this object by providing an easy and convenient means of forming two diametrically spaced openings in an end of a container, and the means also serving as a removable seal for the openings after the latter are formed.

Another object of the invention is to supply a combined can opening and sealing device that has a simple mechanical structure, can be fabricated from standard commercially available materials, is simple and easy to use, and may be resaled at a sufficiently low price as to encourage the widespread use thereof.

SUMMARY OF THE INVENTION

The invention is a portable device for forming two diametrically spaced openings in a circular metallic first end of a container, which container has a cylindrical side wall, and removably sealing the openings in the container after the latter is formed.

The invention comprises a first U-shaped rigid member that includes a pair of spaced transversely arcuate legs that slidably engage the exterior surface of the side walls of the container adjacent the first end thereof. The U-shaped member includes a rigid web that extends between the legs and is connected to first ends thereof, with the web having first and second oppositely disposed side surfaces and the web adjacent the pair of legs having a pair of V-shaped slits formed therein. The portion of the web within the pair of slits is deformed to extend from the first side surface of the web in the same direction as the legs extend. The deformed portions of the web define a pair of triangular shaped prongs that are angularly positioned relative to the web, and the pair of prongs having pointed ends.

A pair of spaced, resilient pads are bonded to the first side surface of the web, with the pads having slits formed therein through which the prongs extend. A handle is secured to the second side surface of the web, and this handle permitting a user to cause the pair of legs to slidably engage the exterior surface of the side wall of the container adjacent the first end thereof, and the device thereafter moved longitudinally relative to the container for the pair of prongs to pressure contact the first end and form two triangularly shaped openings therein. The openings so formed are diametrically spaced from one another. The openings are resiliently sealed after being formed by pressure contact of the pair of resilient pads with the first end of the container.

The device is removable from the container to permit the latter to be tilted in an appropriate manner for liquid to discharge by gravity through one of the openings as air enters the other of the openings. After a desired amount of liquid has been dispensed from the container as above-described, the container is disposed in an upright position, and the invention is then repositioned on the first end of the container for the prongs to engage the openings, and the resilient pad sealingly contacting the end of the container to prevent foreign material in the ambient atmosphere entering the container through the openings.

DESCRIPTION OF THE PREFERRED EMBODIMENTS

Figure 1:
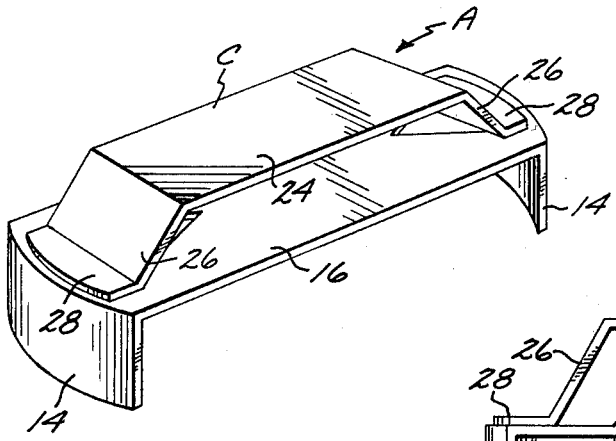
FIG. 1 is a perspective view of the combined can opening and sealing device.
Figure 2:
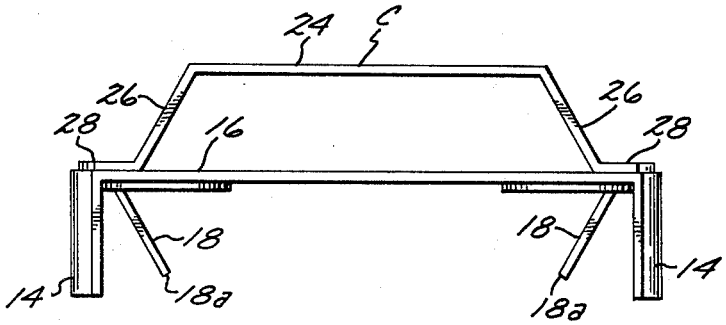
FIG. 2 is a side elevational view of the device shown in FIG. 1.
Figure 3:
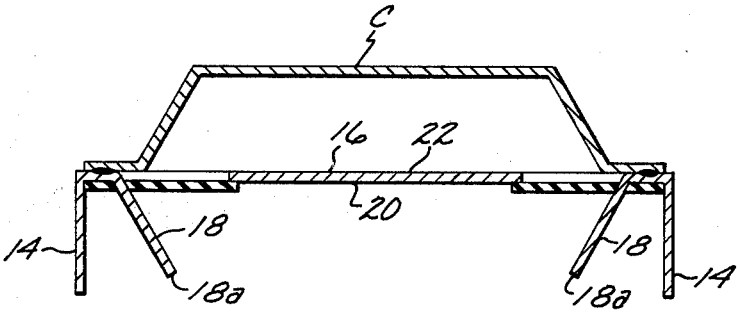
FIG. 3 is a longitudinal cross-sectional view of the device shown in FIG. 1.
Figure 4:
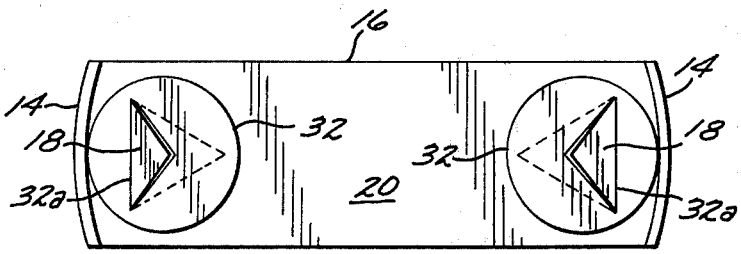
FIG. 4 is a bottom plan view of the device shown in FIG. 1.
Figure 5:
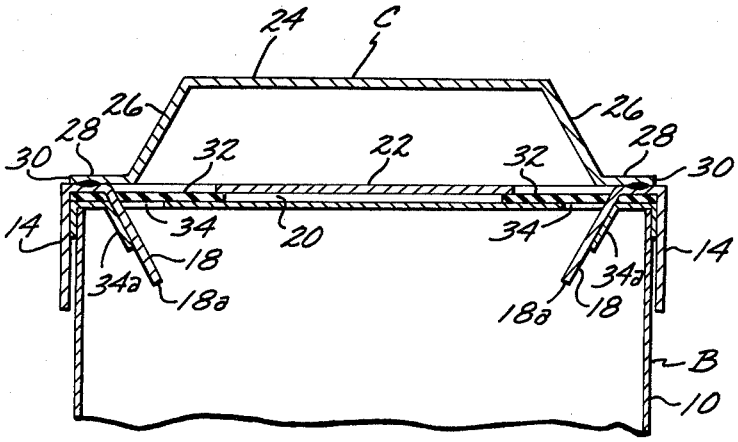
FIG. 5 is a transverse cross sectional view of the device removably mounted on a container, and after the prongs have formed two diametrically spaced openings in an end of the container, and the openings so formed being removably sealed by resilient pads that are secured to the device.

The combined can opening and sealing invention A, as may best be seen in FIG. 1 is of such structure that it may removably engage a container B that has a cylindrical side wall 10 and a circular first end 12 to not only form two diametrically spaced openings in the first end 12, but seal the openings after they are formed as illustrated in FIG. 5. The invention A includes a pair of legs 14 of transverse arcuate cross section as may be seen in FIG. 4, which legs have a web 16 extending therebetween as illustrated in FIGS. 3 and 4. The web 16 adjacent the legs 14 has two V-shaped slits formed therein, with the portions of the web within the slit being deformed downwardly to define two triangularly shaped prongs 18. In FIG. 2 it will be seen that the prongs 18 extend downwardly and inwardly towards one another and are angularly positioned relative to the web 16. The web 16 has a first lower surface 20 as viewed in FIG. 3 and a second upwardly disposed surface 22. The pair of legs 14 each have a transverse interior surface that is of substantially the same radius of curvature as the exterior surface of the cylindrical side wall 10 as may be seen in FIG. 5. The web 16 has a handle C secured to the second surface 22 thereof. The handle C is illustrated in FIG. 5 as being generally U-shaped, and includes a cross piece 24 that has members 26 extending downwardly and outwardly from the ends thereof, and the members 26 having tabs 28 on the free ends thereof that are permanently secured to the second surface 22 of the web 16 by welding beads 30 or the like. Two circular resilient pads 32 are secured to the first surface 20 of the web 16, with the pads 32 having slits 32*a* formed therein through which the prongs 18 extend.

When the invention A has the handle C grasped by a user (not shown), the legs 14 are brought into slidable contact with the upper portion of the cylindrical wall 10 of container B, with the invention thereafter being moved downwardly.

When the prongs 18 pressure contact the first end 12, they are forced therethrough and form openings 34 in the end 12 as may be seen in FIG. 5. In forming the openings 34, triangularly-shaped sections 34*a* of the end 12 are forced downwardly to the positions illustrated in FIG. 5. After the openings 34 are formed as above-described, the resilient pads 32 are in abutting contact with the exterior surface of the end 12 of container B, and removably seal the openings 34 that have been formed therein.

When it is desired to pour a liquid (not shown) from the container B, the container is raised and disposed in an appropriate tilted position to permit liquid to flow by gravity through one of the openings 34, with air entering the interior of the container B through the other of the openings.

After the liquid has been dispensed from the container, the container B is positioned upright on a suitable support, and the invention A is returned to the position illustrated in FIG. 5, where the prings 18 extend through the openings 34, and the resilient pads 32 are in sealing contact with the first end 12 of the container B.

The legs 14 extend from the web 16 a greater distance than the distance of the pointed ends 18*a* of prongs 18 from the web. Due to this construction, the legs 14 are in slidable guiding contact with the cylindrical side wall 10 prior to the prongs 18 pressure contacting the end 12 to form openings 34 therein.

The use and operation of the invention has been explained previously in detail and need not be repeated.

I claim:

1. A portable device for forming two diametrically spaced openings in a circular metallic first end of a container having a cylindrical side wall and of removably sealing said openings after the latter are formed, said device including:

a. a first U-shaped rigid member that includes a pair of spaced legs of arcuate transverse cross section, which legs slidably engage the exterior surface of said side wall adjacent said first end, and a rigid web that extends between said legs and is connected thereto, said web having first and second oppositely disposed surfaces, said web adjacent said pair of legs having a pair of V-shaped slits formed therein, and the portions of said web within said slits being deformed to extend from said first surface to define a pair of triangular shaped prongs that are angularly positioned relative to said web, said pair of prongs having pointed ends that are spaced from said first surface a distance less than that of the free extremities of said pair of legs;

b. a pair of spaced resilient pads bonded to said first surface, said pads having slits formed therein through which said prongs extend; and c. a handle secured to said second surface, said handle permitting a user to cause said pair of legs to slidably engage the exterior surface of said side wall adjacent said first end and be moved longitudinally relative thereto for said pair of prongs to pressure contact said first end and from two triangular shaped openings therein, said openings being removably sealed by pressure contact of said pair of resilient pads with the exterior surface of said end, and said device when not sealing said pair of openings being removable from said container to permit liquid to be dispensed through one of said openings when said container is tilted as air enters the other of said openings.

2. A device as defined in claim 1 in which said handle is of substantially U-shape and overlies said web, with said handle including a pair of spaced second members that are bonded to said second surface.

3. A device as defined in claim 2 in which said pads are of circular shape and of substantially greater area than the area of said openings in said end.

4. A device as defined in claim 2 in which the radius of curvature of the surfaces of said legs that slidably engage said cylindrical side wall are substantially the same as the radius of curvature of said side wall.

* * * * *